US009628925B2

(12) United States Patent
Epping et al.

(10) Patent No.: US 9,628,925 B2
(45) Date of Patent: Apr. 18, 2017

(54) EAR CANAL EARPIECE AND EARMOLD UNIT FOR AN EARPIECE

(71) Applicant: Sennheiser electronic GmbH & Co. KG, Wedemark (DE)

(72) Inventors: Heinz Epping, Hildesheim (DE); André Michaelis, Wedemark (DE)

(73) Assignee: Senheiser electronic GmbH & Co. KG, Wedemark (DE)

( * ) Notice: Subject to any disclaimer, the term of this patent is extended or adjusted under 35 U.S.C. 154(b) by 0 days.

(21) Appl. No.: 14/782,143

(22) PCT Filed: Apr. 2, 2014

(86) PCT No.: PCT/EP2014/056596
§ 371 (c)(1),
(2) Date: Oct. 2, 2015

(87) PCT Pub. No.: WO2014/161885
PCT Pub. Date: Oct. 9, 2014

(65) Prior Publication Data

US 2016/0066111 A1 Mar. 3, 2016

(30) Foreign Application Priority Data

Apr. 3, 2013 (DE) ..... 10 2013 205 846

(51) Int. Cl.
*H04R 25/00* (2006.01)
*H04R 1/10* (2006.01)
(Continued)

(52) U.S. Cl.
CPC ..... *H04R 25/652* (2013.01); *G10K 11/002* (2013.01); *G10K 11/22* (2013.01);
(Continued)

(58) Field of Classification Search
CPC ..... G10K 11/02; G10K 11/22; G10K 2210/32272; H04R 1/1016; H04R 1/2873; H04R 25/652
(Continued)

(56) References Cited

U.S. PATENT DOCUMENTS 2,964,596 A 12/1960 Christensen
4,006,321 A 2/1977 Carlson
(Continued)

FOREIGN PATENT DOCUMENTS

DE 199 43 809 3/2001
DE 10 2008 003 248 7/2009
(Continued)

OTHER PUBLICATIONS

International Search Report for Application No. PCT/EP2014/056596 dated Jun. 25, 2014.

*Primary Examiner* — Brian Ensey
(74) *Attorney, Agent, or Firm* — Haug Partners LLP

(57) ABSTRACT

An ear canal earpiece comprising an electroacoustic sound transducer, a first sound guide unit for guiding the sound from the electroacoustic sound transducer, a second sound guide unit for prolonging the first sound guide unit, a third sound guide unit whose outside contour is matched to an inside contour of an ear canal of a user and which surrounds the second sound guide unit, and a sound wall in the region of the second sound guide unit, wherein the sound wall extends between the second and third sound guide units.

8 Claims, 8 Drawing Sheets

(51) Int. Cl.
*H04R 1/28* (2006.01)
*G10K 11/00* (2006.01)
*G10K 11/22* (2006.01)

(52) U.S. Cl.
CPC ..... *H04R 1/1016* (2013.01); *H04R 1/2873* (2013.01); *G10K 2210/32272* (2013.01)

(58) Field of Classification Search
USPC ..... 381/322, 324, 328, 380
See application file for complete search history.

(56) References Cited

U.S. PATENT DOCUMENTS

| | | | | |
|---|---|---|---|---|
| 4,311,206 | A | 1/1982 | Johnson | |
| 4,870,688 | A * | 9/1989 | Voroba | G09B 21/009 381/322 |
| 5,195,139 | A * | 3/1993 | Gauthier | H04R 25/02 381/322 |
| 2009/0214065 | A1 | 8/2009 | Dahl | |
| 2010/0322453 | A1 | 12/2010 | Matsuyama et al. | |
| 2011/0007930 | A1 | 1/2011 | Grell et al. | |
| 2011/0103610 | A1* | 5/2011 | Harsch | H04R 1/1016 381/74 |
| 2011/0311070 | A1 | 12/2011 | Epping | |

FOREIGN PATENT DOCUMENTS

| | | |
|---|---|---|
| DE | 10 2009 008 376 | 8/2010 |
| WO | WO 2007/089845 | 8/2007 |

* cited by examiner

EAR CANAL EARPIECE AND EARMOLD UNIT FOR AN EARPIECE

The present application claims priority from PCT Patent Application No. PCT/EP2014/056596 filed on Apr. 2, 2014, which claims priority to German Patent Application No. DE 10 2013 205 846.2 filed on Apr. 3, 2013, the disclosures of which are incorporated herein by reference in their entirety.

FIELD OF THE INVENTION

The invention concerns an ear canal earpiece and an earmold unit for an earpiece.

Ear canal earpieces generally have an acoustic sound transducer installed in a housing which is fitted intra-aurally, that is to say into the ear canal. Frequently an ear pad is arranged around the housing so that it becomes more pleasant for the user to wear the ear canal earpiece in the ear. Disposed on the housing is an electrical connection for a cable carrying an electric signal to the sound transducer.

To improve the wearing comfort for the user and to achieve a higher level of fitment sealing for the earpiece in the ear canal the earpieces can be fitted into an otoplastic means, here also referred to as an ear-customized ear canal earpiece.

In addition an ear canal earpiece may not be provided with an ear pad, but may be fixed to an otoplastic means. In that case the otoplastic means and the earpiece are not one unit but can be separate. The otoplastic means is here referred to as an earmold portion.

The advantages of an ear-customized solution are a secure fit for the earpiece in the ear canal and better bass reproduction due to the earpiece being better sealed off.

Most high-end ear-customized ear canal earpieces have multi-way systems comprising magnetic drivers. Ear-customized ear canal earpiece with dynamic drivers are generally not used here because of the lower sound quality. The sound transducer is connected to the opening of the otoplastic means by way of a bore or a tube.

When such an ear canal earpiece is fitted into the ear canal of a user then the ear canal earpiece substantially air-tightly closes the ear canal. The sound emitted by the sound transducer thus passes from the ear canal earpiece by way of the ear canal to the eardrum of the user.

The frequency response of such an arrangement arises out of the frequency response of the earpiece and the transmission functions of the sound guide means and the ear canal. The frequency response is therefore heavily dependent on the acoustic properties of the sound transducer, the position of the transducer in the sound guide means and the geometry of the sound guide means and the ear canal. In particular the properties of the resonances which occur between the sound transducer and the ear drum are also dependent on those factors. The ear canal which is closed with the ear canal earpiece has a resonance behaviour upon excitation with one of the occurring resonance frequencies.

The resonance frequency considered can be for example approximately at 6 kHz. The excessive increase in the sound level caused by the resonance characteristic in the region of about 6 kHz has a detrimental effect on sound quality.

The resonance frequency considered can be for example approximately at 6 kHz. The excessive increase in the sound level caused by the resonance characteristic in the region of about 6 kHz has a detrimental effect on sound quality.

As technological background to the invention attention is directed to DE 10 2008 003 248 A2 and DE 10 2009 008 376 A1.

SUMMARY OF THE INVENTION

The object of the present invention is to improve the sound quality of an earpiece. In particular the invention seeks to compensate for influences of the ear canal on the sound quality.

Thus there is provided an ear canal earpiece comprising an electroacoustic sound transducer, a first sound guide unit for guiding the sound from the electroacoustic sound transducer, a second sound guide unit for prolonging the first sound guide unit, a third sound guide unit whose outside contour is matched to an inside contour of an ear canal of a user and which surrounds the second sound guide unit, and a sound wall in the region of the second sound guide unit, wherein the sound wall extends between the second and third sound guide units.

According to the invention the acoustic loading on the sound transducer can be minimized by the sound guide means and the ear canal and the influences of the ear canal resonances on the sound quality can be compensated.

In an aspect of the present invention the sound wall terminates with a first and second end of the sound guide unit or a second end of the sound guide unit projects beyond the sound wall.

In a further aspect of the present invention the sound wall is arranged at a first end remote from the ear of the third sound guide unit.

In a further aspect of the present invention there is provided a $\lambda/4$ resonator in the sound wall.

In a further aspect of the invention a Helmholtz resonator is arranged at least partially in the sound wall.

In a further aspect of the invention a volume of the Helmholtz resonator extends at least partially into the region of the side remote from the ear of the earpiece and outside the sound wall.

The invention also concerns an earmold unit for an earpiece which has an electroacoustic sound transducer and a first sound guide unit for guiding the sound from the electroacoustic sound transducer. The earmold unit has a second sound guide unit for prolonging the first sound guide unit, a third sound guide unit whose outside contour is matched to an inside contour of an ear canal of a user and which surrounds the second sound guide unit, and a sound wall in the region of the second sound guide unit, wherein the sound wall extends between the second and third sound guide units.

Developments of the invention are recited in the appendant claims.

The invention concerns the notion of providing an ear-customized ear canal earpiece which has a wide-band and interference-free frequency response. In that case there is provided an enlargement of the frequency response to high frequencies without troublesome drops in the frequency response.

DETAILED DESCRIPTION OF EMBODIMENTS

It is to be understood that the figures and descriptions of the present invention have been simplified to illustrate elements that are relevant for a clear understanding of the present invention, while eliminating, for purposes of clarity, many other elements which are conventional in this art. Those of ordinary skill in the art will recognize that other elements are desirable for implementing the present invention. However, because such elements are well known in the art, and because they do not facilitate a better understanding of the present invention, a discussion of such elements is not provided herein.

The present invention will now be described in detail on the basis of exemplary embodiments.

Figure 1A:
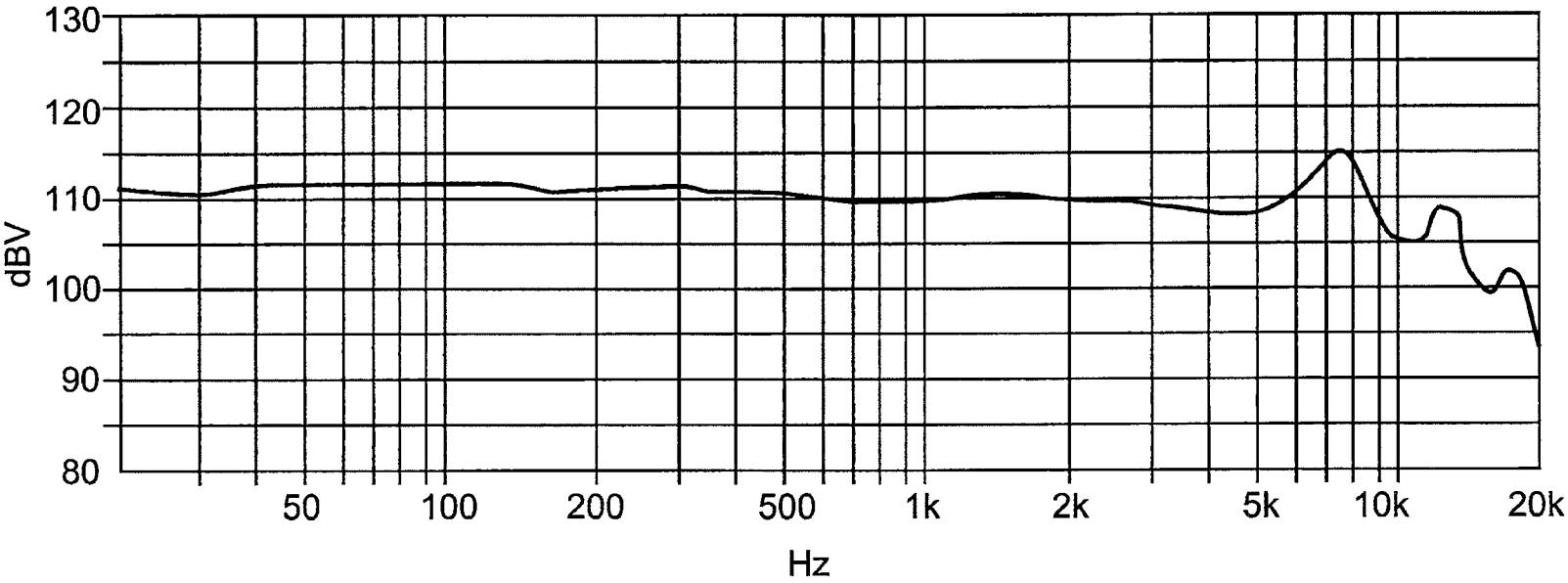
FIG. 1A shows a typical frequency response of an arrangement with an ear canal earpiece and an ear canal according to the state of the art.

FIG. 1A shows a typical frequency response of an arrangement of an ear canal earpiece with an ear canal and an ear canal earpiece in accordance with the state of the art. The frequency of 20 Hz through 20 kHz is logarithmically shown on the X axis. The Y axis represents the amplitude of the frequency response of 80 through 130 dBV. The ear canal of a user is closed by the ear canal earpiece and that arrangement has a resonance frequency. In other words, certain tones, that is to say sound of certain frequencies, which the earpiece gives off, lie in the resonance range of the arrangement and can accordingly be perceived in amplified form by a user. That resonance is a property of the ear canal closed by the ear canal earpiece. The precise position of the resonance frequency is dependent on the geometry of the ear canal, the position at which the ear canal earpiece is disposed in the ear canal, and the acoustic properties of the ear canal earpiece. That resonance frequently occurs at about 7.5 kHz. The excessive increase in resonance in FIG. 1, in the range of between 6 and 9 kHz, wherein the maximum is at about 7.5 kHz, is to be attributed to the resonance of the closed ear canal.

Figure 1B:
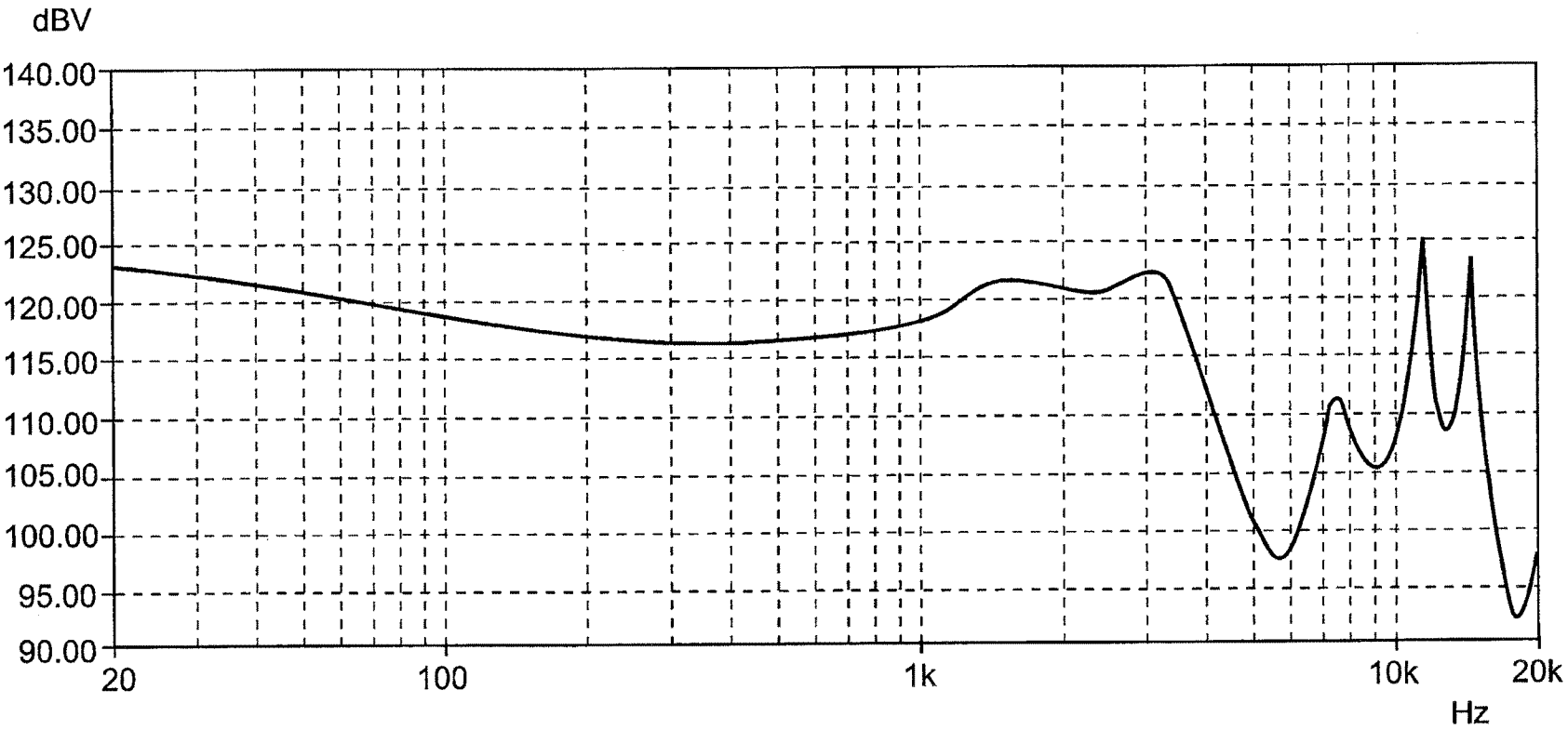
FIG. 1B shows a typical frequency response with an ear-customized ear canal earpiece.

FIG. 1B shows a typical frequency response of an arrangement with an ear-customized ear canal earpiece. By virtue of an ear-customized ear canal earpiece the earpiece is acoustically differently loaded and the spacing relationships with the eardrum are different from the case of a non-ear-customized ear canal earpiece. That leads to a shift in the resonance to markedly lower frequencies like for example 5 or 6 kHz. At frequencies between 3 kHz and 10 kHz there are drops.

So-called ear-customized ear canal earpieces are earpieces which are fitted accurately into an ear canal on the user for example by means of an earmold adaptor or by means of an otoplastic means. The sound is then guided from the electroacoustic transducer by way of a bore (round passages generally produced of standardized small diameters) from the transducer into the rear part of the ear canal of the user. As the earmold portion or otoplastic means is not straight the passage between the electroacoustic sound transducer and the ear-side end of the earmold portion or otoplastic means is not a straight but a curved bore.

An ear-customized ear canal earpiece (that is to say an earpiece in an otoplastic means) or an ear canal earpiece with a (fitted-on) otoplastic means provides that the sound transducer is acoustically loaded differently and the spacing relationships with the eardrum are different from in the case of a non-ear-customized ear canal earpiece.

In the case of an otoplastic means the outside contour of the otoplastic means is matched to the inside contour of an ear canal of a user. Thus the electroacoustic sound transducer of the earpiece is provided at a given spacing relative to the ear-side end of the otoplastic means or the earmold adaptor. In that case the position has an influence on the frequency response of the acoustic pressure which is produced at the eardrum of the user. The size or the outside diameter of the transducer establishes to what minimum spacing relative to the eardrum the transducer can be installed. Typically the size or the outside diameter of the transducer is established by the minimum spacing relative to the ear canal. That is the case as the earpiece with the earmold portion or the otoplastic means can be introduced only as far as a certain point in the ear canal. The sound produced by the electroacoustic sound transducer is guided through the bore or the passage in the earmold portion or the otoplastic means into the ear canal of the user.

Figure 2:
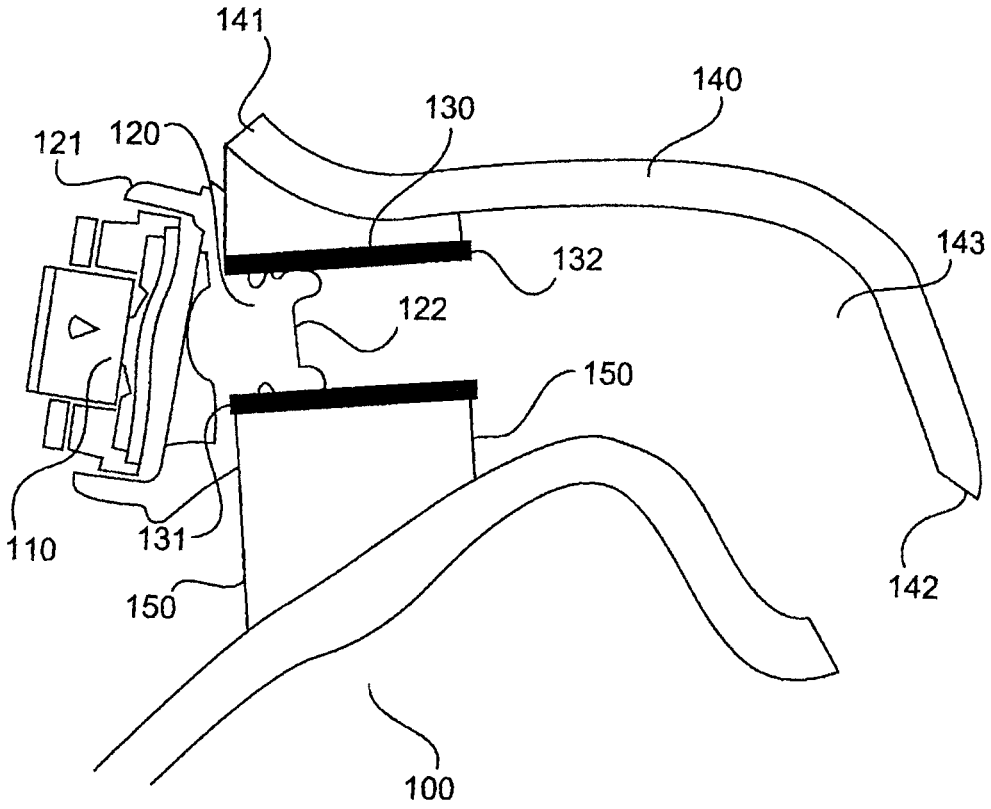
FIG. 2 shows a diagrammatic sectional view of an ear canal earpiece according to a first embodiment.

FIG. 2 shows a diagrammatic sectional view of an ear canal earpiece according to a first embodiment. The earpiece 100 has an electroacoustic transducer 110, a first sound guide unit 120, a second sound guide unit 130 and a third sound guide unit 140. The first sound guide unit 120 is provided in the region of a volume in front of a diaphragm of the electroacoustic transducer 110. The third sound guide unit 140 is in the form of an earmold portion or an otoplastic means. Its outside contour is matched to the inside contour of an ear canal. The second sound guide unit 130 serves to prolong the first sound guide unit 120. Optionally the second sound guide unit can be cylindrical. The length and diameter of the sound guide means of the second sound guide unit 130 are such that the acoustic mass of the first and second sound guide units 120, 130, together with the volume in front of the diaphragm of the transducer 110, produce a resonance frequency which expands the frequency response by the desired proportions.

The first sound guide unit 120 has a first end 121 and a second end 122. The second end 122 is arranged at the side towards the ear while the first end 121 is at the side remote from the ear and can accommodate the electroacoustic transducer 110. The second sound guide unit 130 has a first end 131 at the side remote from the ear and a second end 132 at the side towards the ear. The third sound guide unit has a first end 141 at the side remote from the ear and a second end 142 at the side towards the ear.

The second sound guide unit 130 has a sound wall 150 to provide a clearly delimited acoustic termination. The sound wall 150 is acoustically of a substantially sealing nature. The acoustically substantially sealing sound wall 150 provides that the front side of the electroacoustic transducer is acoustically separated from the rear side thereof. The sound wall 150 can also be in the form of part of the third sound guide unit 140 or in the form of a separate part and can be introduced into a first end 141 of the third sound guide unit 140.

The sound wall 150 and the first sound guide unit 120 are provided in an internal volume 143 of the third sound guide unit 140, preferably in the region of the first end 141.

Optionally the sound wall 150 terminates with the first and second ends 131, 132 of the second sound guide unit 130.

Optionally the third sound guide unit 140 is of a cross-section or inside diameter larger than the cross-section or inside diameter of the second sound guide unit 130.

The outside contour of the third sound guide unit 140 is substantially matched to the inside contour of the ear canal. The thickness of the third sound guide unit 140 is as thin as possible. In that respect a compromise must be adopted between a thickness which is as small as possible for the third sound guide unit 140 in regard to the acoustics on the one hand and a minimum wall thickness in order on the other hand to provide a certain mechanical stability for the third sound guide unit 140.

Preferably the third sound guide unit 140 does not have any constriction in regard to the geometry of the ear canal.

The outside contour of the third sound guide unit 140 very substantially follows the inside contour of the ear canal of the user.

According to an aspect of the invention in the entire region of the third sound guide unit the ratio of the acoustically effective cross-sectional area in comparison with the total cross-sectional area of the outside contour can be everywhere greater than 40%.

The second and third sound guide units 130, 140 can be adapted to be removable from the transducer 110 and the first sound guide unit 120.

Figure 3:
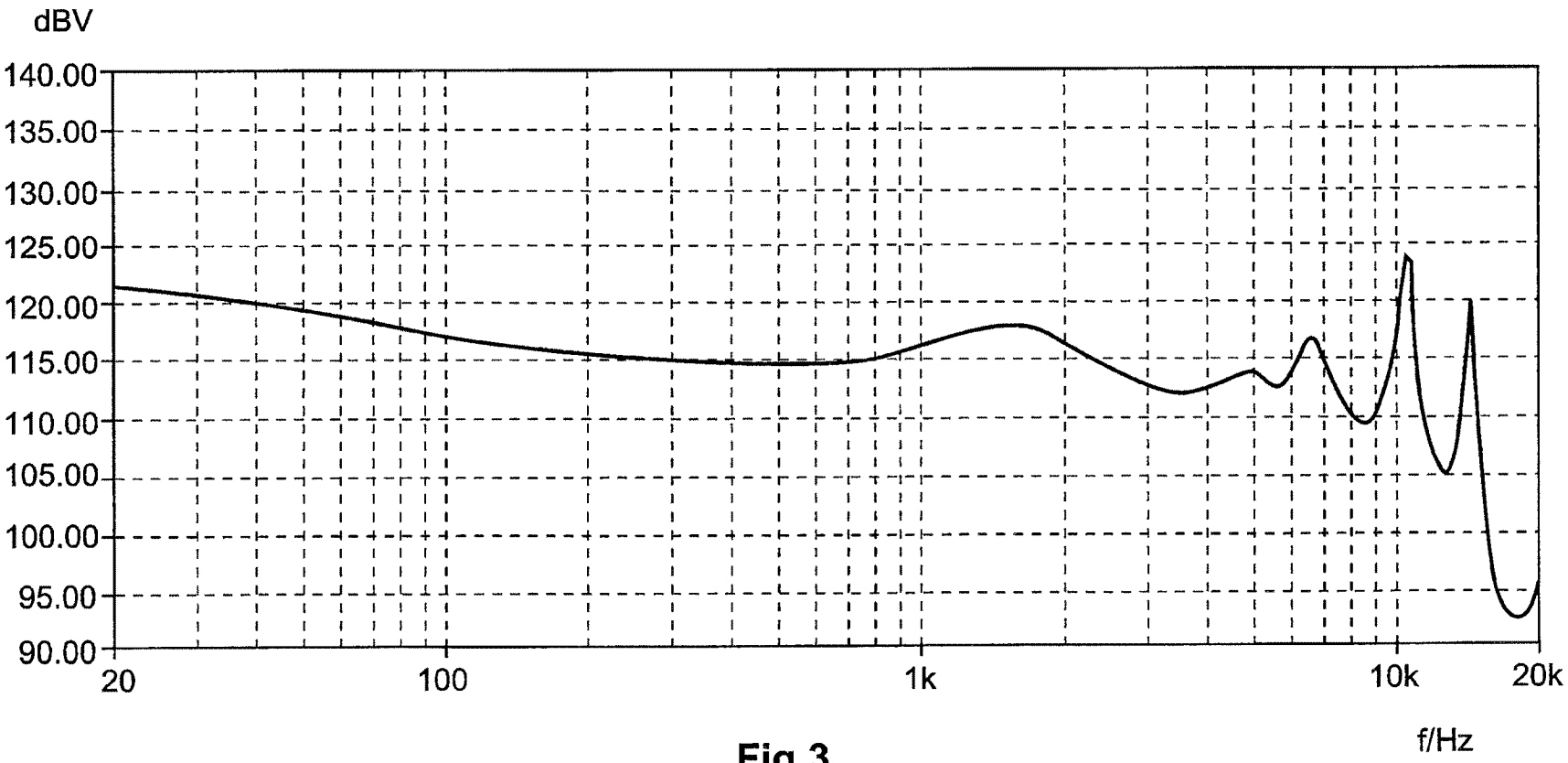
FIG. 3 shows a frequency response of an arrangement of an ear canal and an earpiece according to a first embodiment.

FIG. 3 shows a frequency response of an arrangement of an ear canal and an earpiece according to the first embodiment. In comparison with the frequency response in FIG. 1B a substantial improvement is to be seen in particular in the frequency range between 3 kHz and 10 kHz because the drop in that frequency range with an earpiece according to the invention can be avoided. There is at most still a resonance peak at 6 kHz.

Figure 4:
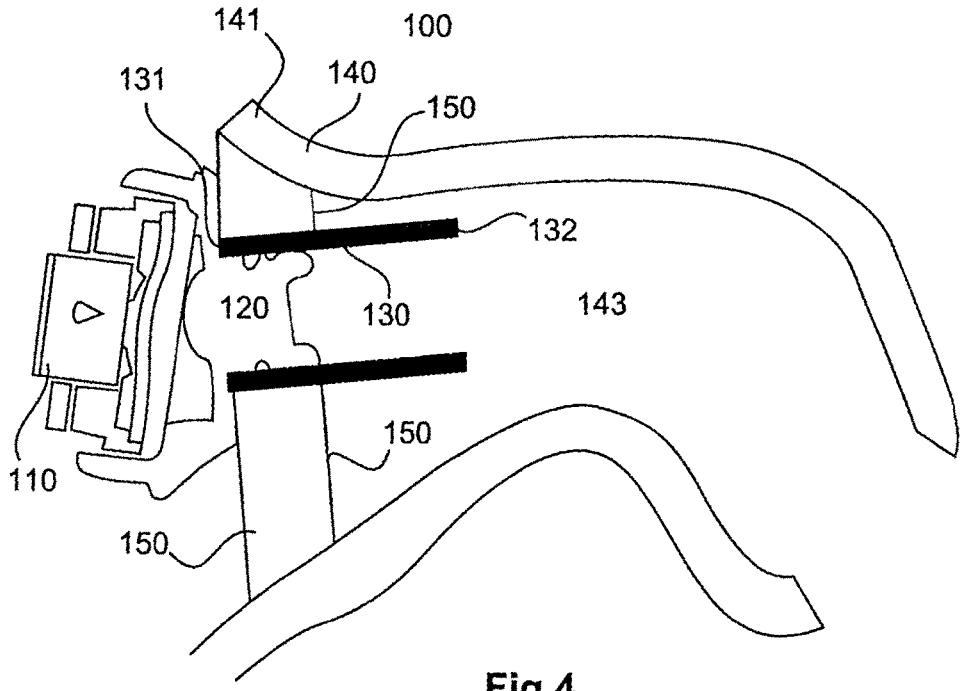
FIG. 4 shows a diagrammatic sectional view of an ear canal earpiece according to a second embodiment.

FIG. 4 shows a diagrammatic sectional view of an ear canal earpiece according to a second embodiment. The ear canal earpiece of the second embodiment substantially corresponds to the ear canal earpiece of the first embodiment of FIG. 2. While the sound wall 150 in the first embodiment terminates substantially flush with the second sound guide unit 130 (that is to say with the first and second ends 131, 132 thereof) the sound wall 150 in the second embodiment is set back further in the direction of the first end 141 of the third sound guide unit 140. Optionally the sound wall 150 can be part of the third sound guide unit 140. Alternatively or additionally thereto the sound wall can be installed as a separate component or glued in place. Alternatively or additionally the sound wall can be produced by the introduction of adhesive.

In the second embodiment the second sound guide unit 130 also does not have to be cylindrical. An oval cross-section or a transition from an oval to a round cross-section or vice-versa is also possible. The second sound guide unit 130 can also be in the form of a funnel portion.

When wearing an ear canal earpiece the earpiece inevitably comes into contact with ear wax (cerumen). A particular problem arises when cerumen is pressed into the sound guide means according to the state of the art. Even small particles already very severely influence the acoustic properties. The manufacturers try to reduce the problem by fitting in front of the openings so-called cerumen filters which have to be regularly changed. However even if the cerumen is caught in the filter the frequency response already changes.

In the solution according to the invention the opening that the ear canal has is so large that on the one hand cerumen which penetrates there has practically no influence on the acoustics and on the other hand the cerumen cannot become fixed there and upon movement practically falls out again.

Figure 5A:
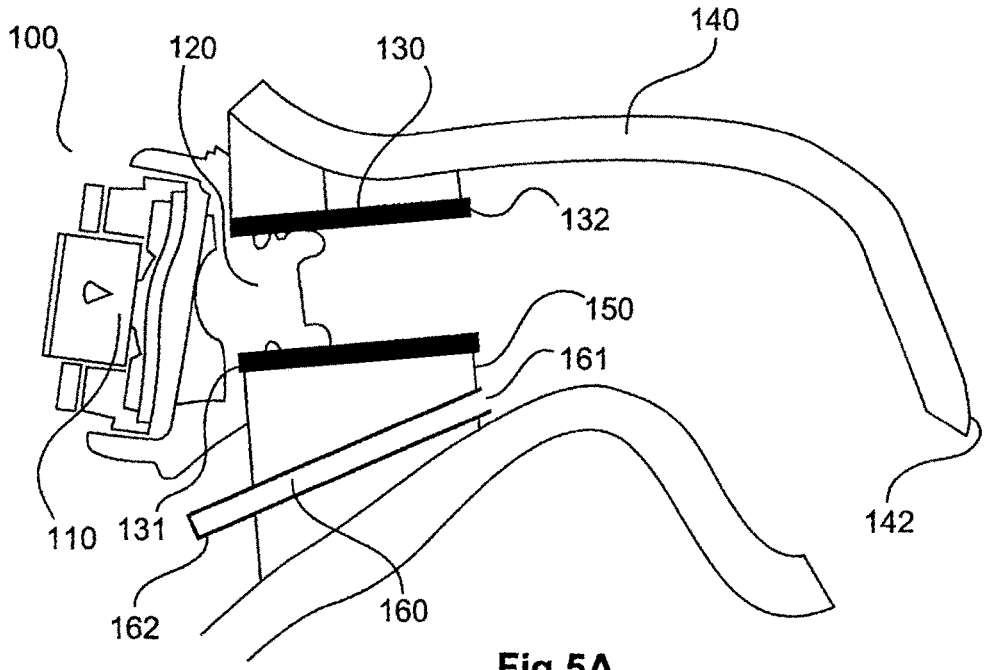
FIG. 5A shows a diagrammatic sectional view of an ear canal earpiece according to a third embodiment.

FIG. 5A shows a diagrammatic sectional view of an ear canal earpiece according to a third embodiment. The ear canal earpiece according to the third embodiment substantially corresponds to that of the first embodiment of FIG. 2. Thus the ear canal earpiece 100 has an electroacoustic transducer 110, a first, second and third sound guide unit 120, 130 and 140 and a sound wall 150 in the region of the second sound guide unit 130. In addition the earpiece according to the third embodiment has a $\lambda/4$ resonator 160 in the region of the sound wall 150. The $\lambda/4$ resonator 160 has a first open end 161 at a side towards the ear and a closed end 162 at the side remote from the ear. The closed end 162 can optionally extend beyond the sound wall 150.

The open end 161 can optionally extend beyond the sound wall 150. The length of the resonator is determined by the wavelength of the frequency to be reduced.

The Helmholtz resonator acts as an acoustic suction circuit and thus reduces the acoustic pressure in the ear canal in the region of the Helmholtz resonance.

Figure 5B:
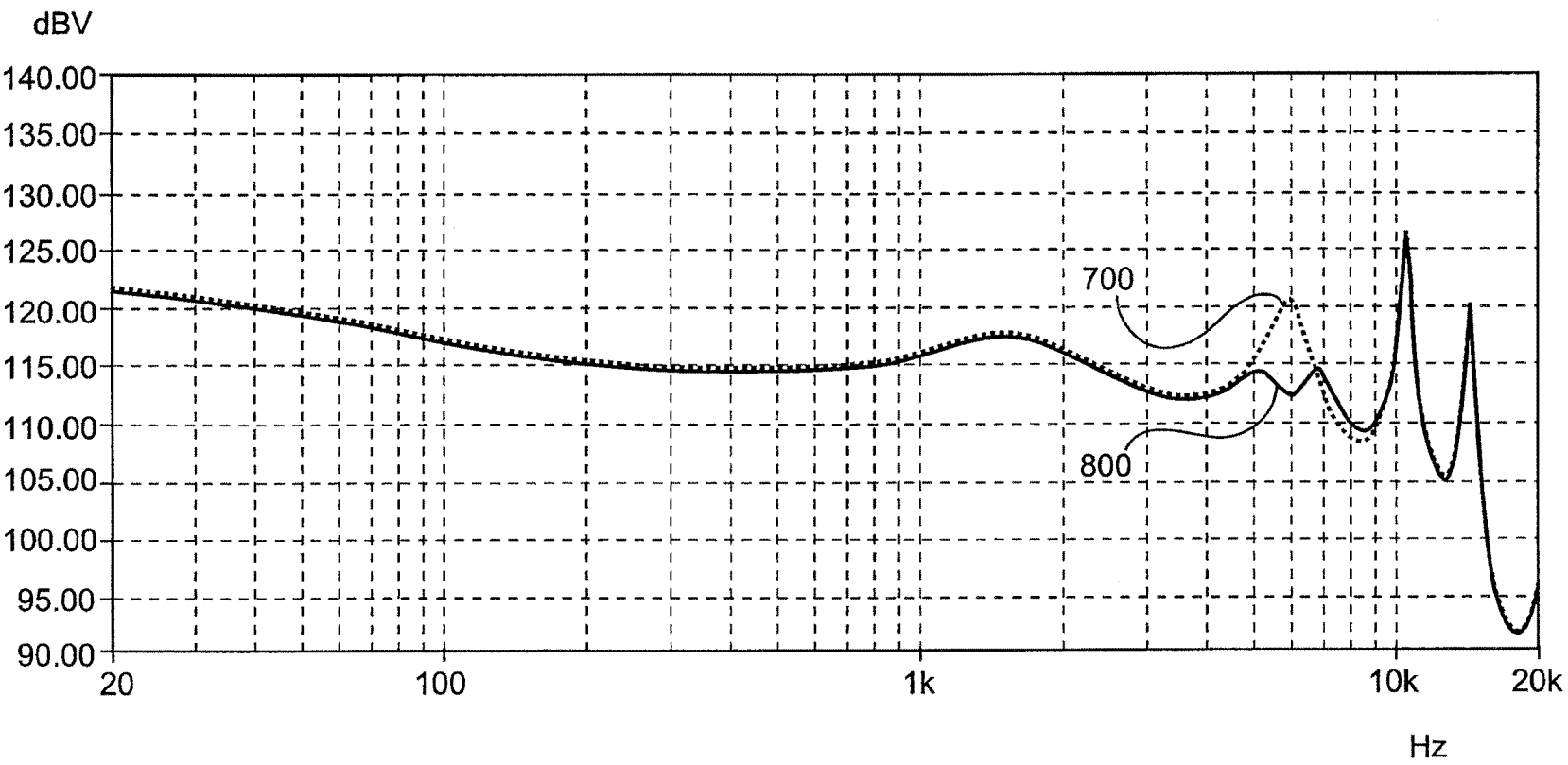
FIG. 5B shows a frequency response of an ear canal earpiece according to the third embodiment.

FIG. 5B shows the frequency response 700 of FIG. 3 as a broken line. The solid line shows the frequency response 800 which is smooth in the region around 6 kHz, in accordance with the third embodiment.

The diameter and the configuration of the cross-section of the resonator 160 determine the quality of the reduction effect. The cross-section of the resonator 160 can be round, oval, polygonal and so forth. The cross-section does not have to be constant over the length. The resonator 160 does not have to be straight but can also be curved or shaped in any other way. One or more acoustic resistances can be disposed in the resonator 160.

A plurality of acoustic suction circuits, that is to say resonators 160, according to the invention, can also be used in an earpiece, which are then preferably tuned to different frequencies.

Figure 6:
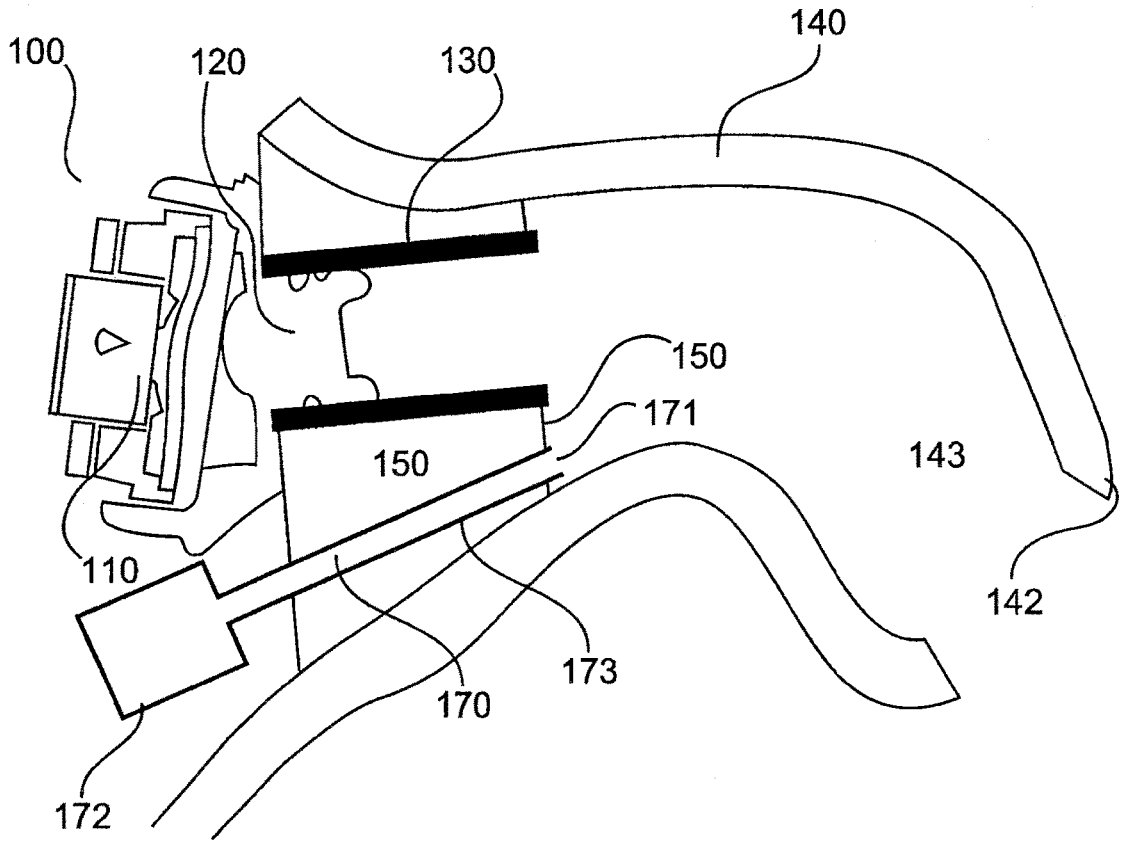
FIG. 6 shows a diagrammatic sectional view of an ear canal earpiece according to a fourth embodiment.

FIG. 6 shows a diagrammatic sectional view of an ear canal earpiece according to a fourth embodiment. The ear canal earpiece according to the fourth embodiment can be based on an ear canal earpiece according to the first or second embodiment. Thus the ear canal earpiece 100 has an electroacoustic sound transducer 110, a first, second and third sound guide unit 120, 130, 140 and a sound wall 150 in the region of the second sound guide unit 130. In addition to the earpiece according to the first or second embodiment the earpiece according to the fourth embodiment has a Helmholtz resonator 170 in the region of the sound wall 150. The Helmholtz resonator 170 has a first open end 171 at the side towards the ear and a volume 172 in the region of the side remote from the ear.

A Helmholtz resonator comprises an element 173 which primarily forms an acoustic mass and a closed-off volume 172. It is so tuned that the Helmholtz resonance corresponds to the disturbing resonance. The Helmholtz resonator serves as an acoustic suction circuit and thus reduces the acoustic pressure in the ear canal in the region of the Helmholtz resonance.

An ear canal earpiece according to the fourth embodiment also makes it possible to achieve an improved frequency response as shown in FIG. 5B.

In accordance with the third and fourth embodiments the sound wall 150 can terminate flush with the second sound guide unit 130. As an alternative thereto the second sound guide unit 130 can project beyond the sound wall in the direction of the side towards the ear, as has been described for example in accordance with the second embodiment.

According to the invention, by virtue of the configuration of the earmold portion or otoplastic means it is possible that the earpiece can be placed further into the ear canal of a user so that it is possible to use a relatively small electroacoustic sound transducer 110 which can be placed further into the ear canal.

According to the fourth embodiment the volume 172 of the Helmholtz resonator 170 can be extended out of the sound wall 150 and can be placed for example beside or behind the electroacoustic sound transducer 110.

Optionally openings can be provided in the first, second and third sound guide units, by which a damping action can be adjusted.

According to the invention the electroacoustic sound transducer can be in the form of a dynamic or magnetic sound transducer.

The third sound guide unit 140 can be in the form of an earmold portion. The sound guide units can also be in the form of part of an otoplastic means.

To permit pressure-free wearing and ease of insertion and removal of the otoplastic means into and from the ear canal material is removed at many a location and this therefore involves a deliberate departure from the inside contour of the ear canal.

Figure 7:
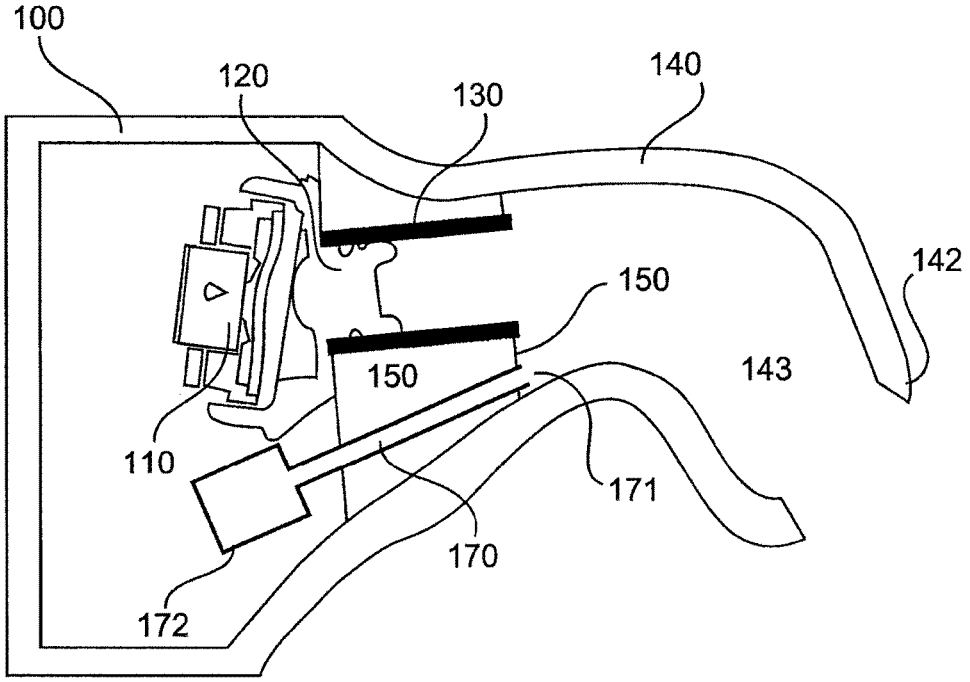
FIG. 7 shows a diagrammatic sectional view of an ear canal earpiece according to a fifth embodiment.

FIG. 7 shows a diagrammatic sectional view of an ear canal earpiece according to a fifth embodiment. The earpiece according to the fifth embodiment can be based on an earpiece according to the first, second, third or fourth embodiment. The earpiece is in the form of an ear-customized ear canal earpiece, that is to say the earpiece can be fitted into an otoplastic means.

Figure 8:
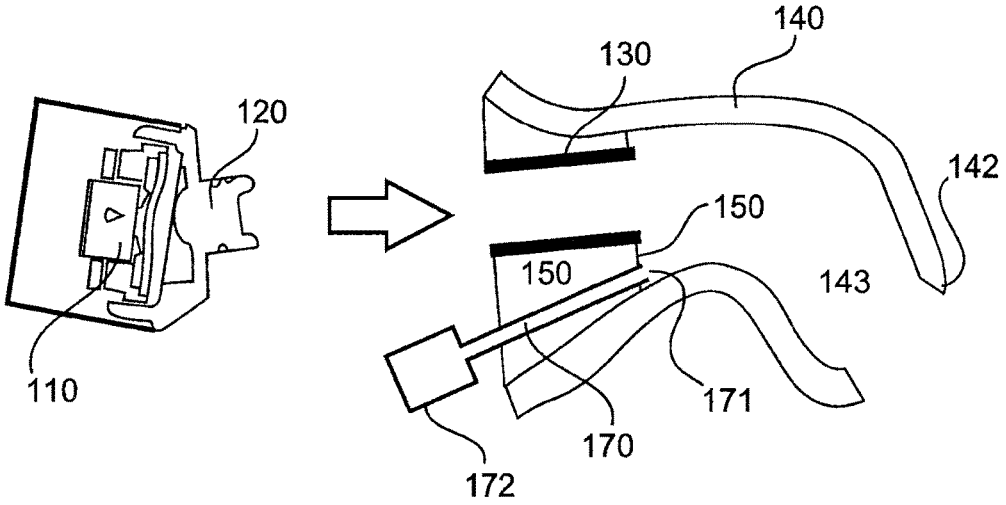
FIG. 8 shows a diagrammatic sectional view of an ear canal earpiece according to a sixth embodiment.

FIG. 8 shows a diagrammatic sectional view of an ear canal earpiece according to a sixth embodiment. The earpiece according to the sixth embodiment can be based on an earpiece according to the first, second, third or fourth embodiment. In the earpiece the ear pad was replaced by an earmold portion. The earmold portion can be in the form of an otoplastic means and can be fitted over the earpiece.

The join between the earpiece and the earmold portion can be in the form of a permanent join or in the form of a join which can be released again by the user, for example by a latching join.

Ear canal earpieces whose sound guide means are designed according to the state of the art and not in accordance with the first and second embodiments can also be provided with the resonators 160 of FIG. 5A and 170 of FIG. 6.

Optionally damping elements can be provided in the first, second and third sound guide unit to additionally influence the frequency response.

According to the invention the second and third sound guide unit can be in the form of part of the earpiece (for example as part of the otoplastic means) or in the form of an earmold portion (earmold unit).

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope of the inventions as defined in the following claims.

The invention claimed is:

1. An ear canal earpiece comprising:

an electroacoustic sound transducer;

a first sound guide unit configured to guide sound from the electroacoustic sound transducer;

a second sound guide unit configured to prolong the first sound guide unit;

a third sound guide unit which surrounds the second sound guide unit and guides sound further to an ear canal of a user and a sound wall which extends between the second and third sound guide units, wherein the sound wall is arranged at an end of the third sound guide unit remote from an ear-facing end of the third sound guide unit, wherein the third sound guide unit is in form of an otoplastic means, wherein an outside contour of the third sound guide unit is substantially matched to an inside contour of the ear channel of the user, and wherein, in an entire region of the third sound guide unit, a ratio of an acoustically effective cross-section area to a total cross-section area of the outside contour of the third sound guide unit is greater than 40%.

2. An ear canal earpiece as set forth in claim 1; wherein the sound wall terminates with a first end and a second end of the second sound guide unit.

3. An ear canal earpiece as set forth in claim 1, further comprising: a $\lambda/4$ resonator arranged in the sound wall.

4. An ear canal earpiece as set forth in claim 1, further comprising: a Helmholtz resonator arranged at least partially in the sound wall.

5. An ear canal earpiece as set forth in claim 4; wherein a volume of the Helmholtz resonator extends in a region of a side of the earpiece outside the sound wall remote from an ear-facing side of the earpiece.

6. An ear canal earpiece as set forth in claim 1; wherein an ear-facing end of the third sound guide unit does not have a constriction.

7. An earmold unit for an earpiece which has an electroacoustic sound transducer and a first sound guide unit for guiding sound from the electroacoustic sound transducer, the earmold unit comprising:

a second sound guide unit configured to prolong the first sound guide unit;

a third sound guide unit which surrounds the second sound guide unit and which guides sound further into an ear canal of a user; and a sound wall which extends between the second and third sound guide units, wherein the sound wall is arranged at an end of the third sound guide unit remote from an ear-facing end of the third sound guide unit, wherein the third sound guide unit is in form of an otoplastic means, wherein an outside contour of the third sound guide unit is substantially matched to an inside contour of the ear channel of the user, and wherein, in an entire region of the third sound guide unit, a ratio of an acoustically effective cross-section area to a total cross-section area of the outside contour of the third sound guide unit is greater than 40%.

8. An ear canal earpiece as set forth in claim 1; wherein a second end of the second sound guide unit projects beyond the sound wall.

* * * * *